US010219558B2

(12) United States Patent
Terrell

(10) Patent No.: US 10,219,558 B2
(45) Date of Patent: Mar. 5, 2019

(54) MEDICAL GOWN

(71) Applicant: Encompass Group, LLC, McDonough, GA (US)

(72) Inventor: Kelley Terrell, Ferris, TX (US)

(73) Assignee: Encompass Group, LLC, McDonough, GA (US)

( * ) Notice: Subject to any disclaimer, the term of this patent is extended or adjusted under 35 U.S.C. 154(b) by 1283 days.

(21) Appl. No.: 14/095,267

(22) Filed: Dec. 3, 2013

(65) Prior Publication Data

US 2015/0150318 A1 Jun. 4, 2015

(51) Int. Cl.
*A41D 13/12* (2006.01)

(52) U.S. Cl.
CPC ..... *A41D 13/1245* (2013.01); *A41D 13/1281* (2013.01)

(58) Field of Classification Search
CPC ..... A41D 13/1236; A44B 18/003
See application file for complete search history.

(56) References Cited

U.S. PATENT DOCUMENTS 3,490,072 A * 1/1970 Keltner ..... A41D 13/1236 2/114
3,748,701 A * 7/1973 De Mestral ..... A44B 18/0038 139/391
3,843,971 A * 10/1974 Delanty ..... A41D 13/1209 2/114
4,055,855 A * 11/1977 Ragone ..... A41D 13/1236 2/105
4,422,186 A * 12/1983 Loney ..... A41D 13/129 2/114
4,570,268 A * 2/1986 Freeman ..... A41D 13/1236 2/114
4,698,848 A * 10/1987 Buckley ..... A41D 13/1245 2/114
4,718,124 A * 1/1988 Sawicki ..... A41D 13/129 2/114
4,759,083 A * 7/1988 Belcher ..... A41D 13/1236 2/114
4,764,986 A * 8/1988 Stewart ..... A41D 13/1245 2/115
4,964,173 A * 10/1990 Gordon ..... A41D 13/1236 2/114
4,971,073 A * 11/1990 Schneider ..... A61F 5/3784 128/869

(Continued)

*Primary Examiner* — Richale L Quinn
(74) *Attorney, Agent, or Firm* — Baker Donelson; Dorian Kennedy

(57) ABSTRACT

A medical gown (10) includes a front side (11) joined to a back side (12) along a top seam (23) having a front side (24) and a back side (25) which are releasably joined together. The top seam front side includes an elongated strip of very small hook type fasteners (28). The top seam back side includes a pair of outer high strength loop type fasteners (31) (high bonding strength) spaced apart to allow the exposure of the exterior surface (20) of the gown back side which forms small loops that are considered an area of low strength loop type fasteners (34) (low bonding strength). The mating of the high strength loop type fasteners with the hook type fasteners provides a higher degree of separation resistance compared to that between the low strength loop type fasteners and the hook type fasteners.

11 Claims, 2 Drawing Sheets

(56) References Cited

U.S. PATENT DOCUMENTS 4,977,622 A * 12/1990 Schley ..... A41D 13/12 2/114
5,062,159 A * 11/1991 Jakub ..... A41D 13/1236 2/105
5,228,141 A * 7/1993 Remsky ..... A41D 13/1236 2/114
5,315,716 A * 5/1994 Baum ..... A41D 1/06 2/114
5,414,867 A * 5/1995 Bowling ..... A41D 13/1209 2/114
5,564,123 A * 10/1996 Grassick ..... A41D 13/1245 2/114
5,611,087 A * 3/1997 Adkins ..... A41D 13/1236 2/114
5,621,917 A * 4/1997 Howsden ..... A41B 13/06 2/111
5,918,310 A * 7/1999 Farahany ..... A41D 13/015 2/228
5,924,133 A * 7/1999 Zapiti ..... A41D 13/1236 2/114
6,115,840 A * 9/2000 Hastings ..... A41D 13/1245 2/114
6,237,153 B1 * 5/2001 Bowens ..... A41D 13/1236 2/114
6,240,563 B1 * 6/2001 Niedermeyer ..... A41D 13/1236 2/114
6,642,160 B1 * 11/2003 Takahashi ..... A44B 18/0011 24/446
6,694,522 B1 * 2/2004 Neal ..... A41D 13/1236 2/114
6,973,673 B2 12/2005 Beuk
7,329,232 B2 * 2/2008 Lipshaw ..... A61F 13/06 128/845
7,526,816 B2 * 5/2009 Shak ..... A41D 11/00 2/114
7,682,686 B2 * 3/2010 Curro ..... A61F 13/00 428/156
7,819,911 B2 * 10/2010 Anderson ..... A61F 7/00 607/104
7,987,524 B2 * 8/2011 Bower ..... A41D 13/1245 2/106
8,097,031 B2 * 1/2012 Anderson ..... A61F 7/00 607/104
8,161,573 B1 * 4/2012 Burns-Cox ..... A41D 13/1245 2/227
8,313,519 B2 * 11/2012 Anderson ..... A61F 7/00 607/104
2003/0126688 A1 7/2003 Scroggins
2005/0102731 A1 * 5/2005 Beuk ..... A41D 13/1281 2/114
2005/0132463 A1 * 6/2005 Kathumbi-Jackson ..... A41D 13/1209 2/51
2005/0132465 A1 * 6/2005 Kathumbi-Jackson ..... A41D 13/1209 2/114
2006/0019055 A1 * 1/2006 Lester, Jr. ..... A44B 18/0011 428/85
2006/0085890 A1 4/2006 Beuk
2008/0000006 A1 * 1/2008 Ochoa ..... A41D 13/1236 2/114
2008/0177361 A1 * 7/2008 Anderson ..... A61F 7/0097 607/108
2008/0184455 A1 * 8/2008 Blume ..... A41D 13/1281 2/114
2009/0106872 A1 * 4/2009 Collins ..... A41D 13/1236 2/69
2009/0228083 A1 * 9/2009 Anderson ..... A61F 7/00 607/107
2010/0242150 A1 * 9/2010 Trouillot ..... A41D 13/1245 2/114
2012/0137400 A1 * 6/2012 Farris ..... A41D 13/1245 2/114
2013/0067633 A1 * 3/2013 Salem ..... A41D 13/1245 2/102
2013/0276202 A1 * 10/2013 Forbes ..... A41D 13/1236 2/114
2015/0297425 A1 * 10/2015 Nordlinder ..... A61F 13/64 2/312

* cited by examiner

MEDICAL GOWN

TECHNICAL FIELD

The present invention relates generally to medical gowns and more specifically to medical gowns which are adapted to be used for access to a patient during medical procedures and surgery and/or in conjunction with other medically related equipment.

BACKGROUND OF THE INVENTION

Heretofore, medical gowns have been designed to allow access to the body of a patient undergoing an examination or medical procedure. These gowns are oftentimes designed in segments or portions that are held together with hook and loop type fasteners, snaps, ties or other fasteners. The purpose of the segmentation of the gowns is to allow access to the underlying body part of the patient while maintaining coverage of the remainder of the patient's body.

A problem however arises when access to a patient is limited by a gown or when a patient coupled or hooked-up to other medical devices which include wires or tubes coupled to the patient's body, such as electrical heart monitoring devices, oxygen monitoring devices, intravenous fluid tubes, catheters, or other similar medical devices which include wires or tubes. These wires or tubes are typically extended under the gown though the bottom opening, neck opening, or sleeve opening. However, by positioning the wires or tubes in such a manner they are unsecure and may become entangled with the patient, or a tube may become kinked or collapsed due to a patient's body weight being placed upon it.

Accordingly, it is seen that a need remains for a medical gown that provides a better access to a patient and/or subsequent wearing of medical related equipment having wires or tubes attached to a patient's body. It is to the provision of such therefore that the present invention is primarily directed.

BRIEF SUMMARY OF THE INVENTION

In a preferred form of the invention a medical gown comprises a front side, a back side, and a releasable seam joining at least a portion of the front side to a portion of the back side. The releasable seam includes a first fastener portion coupled to one side which includes two high strength loop type fasteners spaced apart from each other and a low strength loop type fastener positioned between the two high strength loop type fasteners. The releasable seam also including a second fastener portion coupled to the other side which includes hook type fasteners configured to releasable mate with high strength loop type fasteners and the low strength loop type fastener.

DETAILED DESCRIPTION

Figure 1:
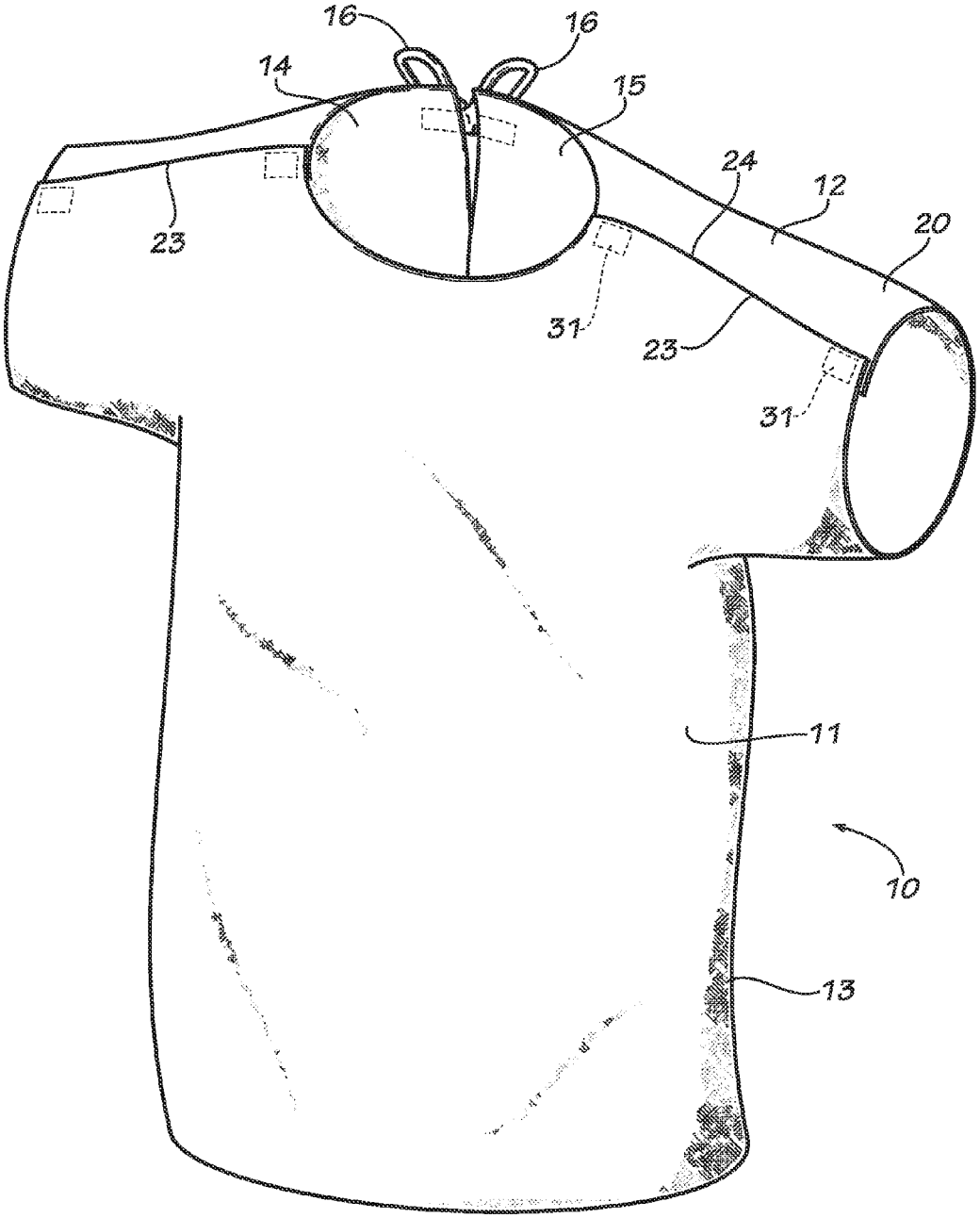
FIG. 1 is a perspective view of a medical gown embodying principles of the invention in a preferred form.

With reference next to the drawings, there is shown a medical gown 10 in a preferred form of the invention. The medical gown 10 has a front side or portion 11 joined to a back side or portion 12 which in combination forms a body covering 13. The back side 12 is divided into a right side 14 and a left side 15, each of which includes ties 16 which when tied together secure the two sides (14 and 15) together. The gown back side 12 is made of lofted, billow spunbond thermoplastic (for example a polypropylene) non-woven material which includes extremely small fibers or fiber loops within the material. If the garment back side 12 is made of a multilayer material, the exterior surface 20, or at least a portion of it, is preferably made of the lofted billow spunbond thermoplastic non-woven material. Similarly, the front side 11 is made of a lofted, billow spunbond thermoplastic non-woven material, which includes extremely small fibers of fiber lops within the material, however, the front side may also include a metalized layer to provide additional thermal protection of the patient. These garment materials provide a great deal of comfort and warmth to a patient. The gown front side 11 may be made of a heat reflective, metalized material, such as that sold by Encompass Group, LLC of McDonough, Ga. under the tradename THERMOFLECT. The metalized material has an interior facing layer or surface which is a lofted billow spunbond thermoplastic non-woven material having extremely small fibers or fiber loops within the material.

Each sleeve or sleeve area of the gown includes a top seam 23 wherein a top seam front side or portion 24 and a top seam back side or portion 25 are releasably joined together. The top seam front side 24, associated with the gown front side 11, includes an elongated strip of very small hook type fasteners 28 along substantially the entire length of the top seam front side 24. The top seam back side 25, associated with the gown back side 12, includes a pair of outer high strength loop type fasteners 31 (high bonding strength) spaced apart from each other at opposite ends of the top seam back side 25. The space or spacing 33 between and immediately adjacent to the high strength loop type fasteners 31 allows the exposure of the exterior surface 20 of the gown back side 12 therebetween. The spacing 33 or exposure of the small loops of the back side exterior surface 20 layer may be considered an area of low strength loop type fasteners 34 (low bonding strength) because of the material composition of small loops therein. The mating of the high strength loop type fasteners with the hook type fasteners 28 provides a higher degree of separation resistance compared to the separation resistance between the low strength loop type fasteners (gown back side material) and the hook type fasteners 28.

Figure 2:
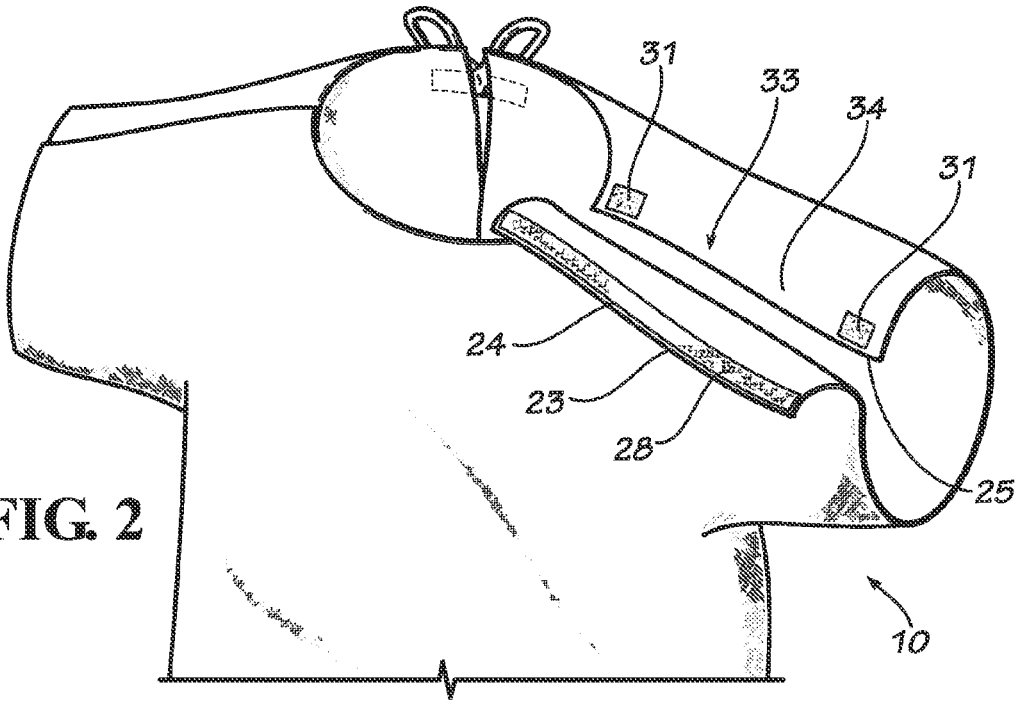
FIG. 2 is a perspective view of the medical gown show in FIG. 1, shown with the fasteners in an open configuration.
Figure 3:
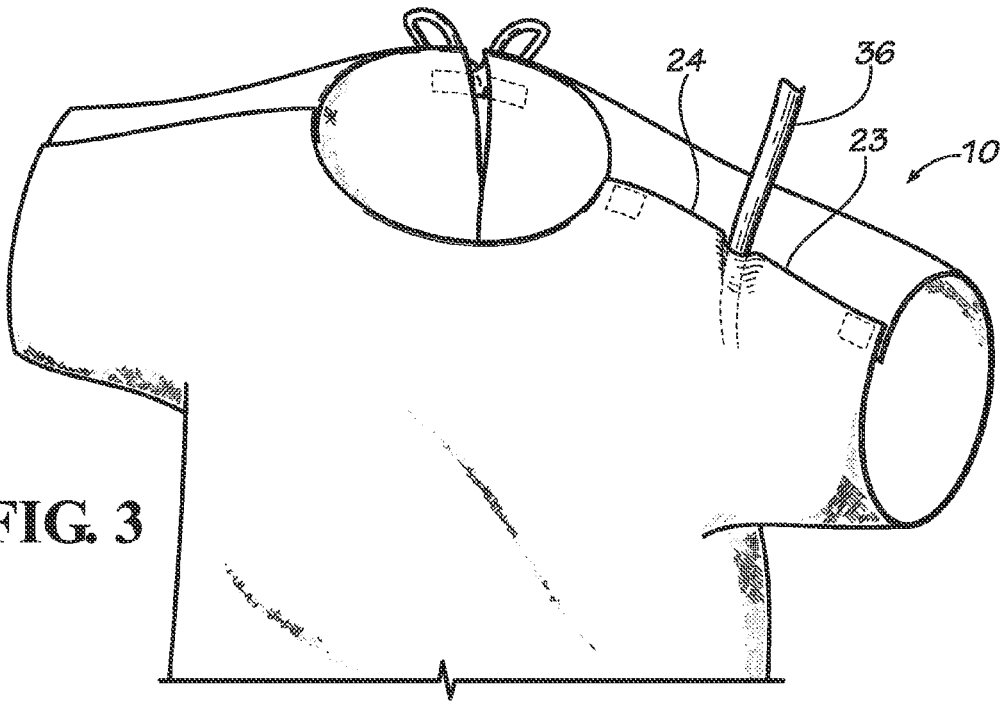
FIG. 3 is a perspective view of the medical gown show in FIG. 1, shown in a closed configuration with medical equipment tube passing through the medical gown seam.

In use, a patient dons the medical gown 10 in a customary manner. Should access to a patient beneath the gown be required during a medical procedure or surgery or should the wiring or tubes 36 of an external or ancillary medical device be coupled to the patient, a medical professional simply pulls the top seam front side 24 and the top seam back side 25 apart to open or at least partially open the top seam 23, as shown in FIG. 2. The wiring or tubing 36 of the external device is then positioned within the space 33 of low strength loop type fasteners 34 between the two high strength loop type fasteners 31. The top seam front side 11 is then re-mated with the top seam back side 12 with the wiring and tubing 36 captured therebetween.

With the top seam closed, the elongated strip of very small hook type fasteners 28 mates or is coupled with the high strength loop type fasteners 31 to prevent the unwanted separation or opening of the top seam 23. Simultaneously, the elongated strip of very small hook type fasteners 28 also mates with the low strength loop type fasteners 34 surrounding or on either side of the wire or tube 36, thereby providing a weaker bonding or joining which is capable of holding the wire or tube in place yet allows for quick and easy relocating or removal of the wire or tube at a later time by simply opening this area of the top seam 23 without releasing or disturbing the joinder with the high strength loop type fasteners.

It should be understood that the concept may also be incorporated into a seam wherein one end of the seam is permanently joined and the opposite end is open. Here, the end of the seam opposite the joined end would include a high strength loop type fastener and the remainder of the seam between the high strength loop type fastener and the joined end would include low strength loop type fasteners.

As used herein, the term low strength loop type fasteners or the like is intended to define that which can easily be unfastened from the hook type fasteners or provides a weak bond therebetween, so that the coupling may be manually unfastened and the wires or tubes relocated without much physical pulling on the covering 13. The term high strength loop type fasteners or the like is intended to define a more stable joining of the covering portions in order to secure the two covering portions together to prevent the unwanted separation therebetween should the patient turn, walk, sit-up, or otherwise move in a normal fashion. The term strip used herein may include a continuous strip of material as well as strips formed from multiple segments, which may or may not include small spaces between adjacent segments. The term bonding strength is intended to reflect the strength taken to separate the bonding between two joined fasteners portions. The arrangement of these fasteners allows for the seam to be closed along its entire length, as opposed to spaced apart fasteners, such as snaps or the like, which only secure or close the seam at select locations while allowing the seam to be open between adjacent fasteners. This complete closing of the seam provides a greater degree of comfort and warmth to a patient.

It should be understood that the relative positions of the loop and hook type fasteners can be reversed, i.e., the hook type fasteners may be associated with the back side 12 while the loop type fasteners are associated with the front side 11.

It should also be understood that rather than having the gown material itself provide the low strength loop type fasteners, an additional strip or length of low strength loop type fasteners may be coupled to the gown opposite the hook type fasteners 23.

It should be understood that the releasable nature of the hook and loop fasteners allows the gown to be custom fitted to a patient by allowing coupling of the fasteners to vary, the material to be gathered and then fastened, or to release certain locations.

It thus is seen that a medical gown is now provided that provides the ability to hold the wires or tubes of a device coupled to a patient. Although the medical examination gown has been illustrated and described in its preferred form, it should be understood that many modifications, additions and deletions may be made to that specific form without departure from the spirit and scope of the invention as set forth in the following claims.

What is claimed is:

1. A medical gown comprising:

a front side;

a back side, and a releasable seam joining at least a portion of said front side to a portion of said back side, said releasable seam including a first fastener portion coupled to one said side, said first fastener portion including two high strength loop type fasteners spaced apart from each other and a low strength loop type fastener positioned between said two high strength loop type fasteners, said releasable seam also including a second fastener portion coupled to the other said side, said second fasteners portion including hook type fasteners configured to releasable mate with said high strength loop type fasteners and said low strength loop type fastener.

2. The medical gown of claim 1 wherein said releasable seam is positioned along a joining of said front side and said back side along a sleeve.

3. The medical gown of claim 1 wherein said low strength loop type fasteners are formed by the material from which the one said side is made.

4. A medical gown comprising, a body covering having a releasable seam to provide access to the body, said releasable seam having a first seam portion mounted to a first body covering portion of said body covering and a second seam portion mounted to a second body covering portion of said body covering, said first seam portion having at least one area of high strength loop type fasteners and an elongated area of low strength loop type fasteners, said second seam portion having an elongated area of hook type fasteners adapted to mate with said high strength loop type fasteners and said low strength loop type fasteners.

5. The medical gown of claim 4 wherein said body covering includes sleeves and wherein said releasable seam is positioned along at least one said sleeve.

6. The medical gown of claim 4 wherein said low strength loop type fasteners are formed by the material from which at least a portion of said body covering is made.

7. A medical gown comprising, a body covering having a first portion and a second portion, and a releasable fastener joining said first portion to said second portion, said releasable fastener including a first fastener portion having a first bonding strength and a second fastener portion having a second bonding strength less than said first bonding strength and positioned immediately adjacent said first fastener portion.

8. The medical gown of claim 7 further comprising a third fastener portion having said first bonding strength, and wherein said second fastener is positioned between and immediately adjacent said first and third fastener portions.

9. The medical gown of claim 7 wherein said first fastener portion is comprised of a first loop type fastener, and wherein said second fastener portion is comprised of a second loop type fastener.

10. The medical gown of claim 7 wherein said body covering includes sleeves and wherein said releasable fastener is positioned along at least one said sleeve.

11. The medical gown of claim 9 wherein said second loop type fastener is are formed by the material from which at least a portion of said body covering is made.

* * * * *